US007571773B1

(12) United States Patent
West et al.

(10) Patent No.: US 7,571,773 B1
(45) Date of Patent: Aug. 11, 2009

(54) MULTIPLE BALL LAUNCH ASSEMBLIES AND METHODS OF LAUNCHING MULTIPLE BALLS INTO A WELLBORE

(75) Inventors: Lonnie C. West, The Woodlands, TX (US); Jason C. Mailand, The Woodlands, TX (US); Winfield M. Sides, III, Bellaire, TX (US); Glenn A. Bahr, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/148,270

(22) Filed: Apr. 17, 2008

(51) Int. Cl.
*E21B 33/13* (2006.01)

(52) U.S. Cl. ..... 166/373; 166/75.15; 166/97.1; 137/268

(58) Field of Classification Search ..... 166/70, 166/75.15, 97.1, 373, 379, 386; 137/268
See application file for complete search history.

(56) References Cited

U.S. PATENT DOCUMENTS

| | | | | | |
|---|---|---|---|---|---|
| 2,790,500 | A | * | 4/1957 | Jones | 166/75.15 |
| 3,011,196 | A | * | 12/1961 | Glover | 15/104.062 |
| 3,039,531 | A | * | 6/1962 | Scott | 166/70 |
| 3,086,587 | A | * | 4/1963 | Zandmer et al. | 166/284 |
| 3,372,705 | A | * | 3/1968 | Bodhaine | 137/268 |
| 3,403,729 | A | * | 10/1968 | Hickey | 166/75.15 |
| 3,715,055 | A | | 2/1973 | Kendrick et al. | |
| 4,033,408 | A | * | 7/1977 | Fredd et al. | 166/75.15 |
| 4,132,243 | A | | 1/1979 | Kuus | |
| 4,268,932 | A | * | 5/1981 | Hogan | 15/104.062 |
| 4,420,040 | A | | 12/1983 | Arbasak et al. | |
| 4,491,177 | A | | 1/1985 | Baugh | |
| 4,759,469 | A | | 7/1988 | Lowrance et al. | |
| 4,889,259 | A | | 12/1989 | Lowrance et al. | |
| 5,095,988 | A | | 3/1992 | Bode | |
| 5,127,472 | A | | 7/1992 | Watson et al. | |
| 5,277,248 | A | | 1/1994 | Breland | |
| 5,758,726 | A | | 6/1998 | Streich et al. | |
| 6,220,360 | B1 | | 4/2001 | Connell et al. | |
| 6,286,540 | B1 | * | 9/2001 | Bonicontro | 137/268 |

(Continued)

OTHER PUBLICATIONS

D.W. Thomson, et al., Design and Installation of a Cost-Effective Completion System for Horizontal Chalk Wells Where Multiple Zones Require Acid Stimulation, SPE Drilling & Completion, Sep. 1998, pp. 151-156, Offshore Technology Conference, U.S.A.

(Continued)

*Primary Examiner*—Jennifer H Gay
*Assistant Examiner*—Blake Michener
(74) *Attorney, Agent, or Firm*—Greenberg Traurig LLP; Anthony F. Matheny

(57) ABSTRACT

Multiple ball launch assemblies comprise a plurality of ball launch pods disposed around an outer wall surface of a housing. The ball launch pods are operatively associated with a flow tube disposed within the housing. An actuator assembly rotates the flow tube to align a first opening in the flow tube with a first ball launch pod so that a first ball is launched into the wellbore. Further rotation of the flow tube aligns subsequent openings in the flow tube with subsequent corresponding ball launch pods so that subsequent balls are launched into the wellbore.

20 Claims, 8 Drawing Sheets

U.S. PATENT DOCUMENTS

| | | | | |
|---|---|---|---|---|
| 6,302,199 | B1 | 10/2001 | Hawkins et al. | |
| 6,575,238 | B1 | 6/2003 | Yokley | |
| 6,672,384 | B2 | 1/2004 | Pedersen et al. | |
| 6,715,541 | B2 | 4/2004 | Pedersen et al. | |
| 6,776,228 | B2 | 8/2004 | Pedersen et al. | |
| 6,789,619 | B2 | 9/2004 | Carlson et al. | |
| 6,802,373 | B2 | 10/2004 | Dillenbeck et al. | |
| 7,055,611 | B2 | 6/2006 | Pedersen et al. | |
| 2008/0053660 | A1 * | 3/2008 | Angman | 166/373 |
| 2008/0223586 | A1 * | 9/2008 | Barnett | 166/386 |

OTHER PUBLICATIONS

H.A. Nasr-El-Din, et al., Laboratory Evaluation Biosealers, Feb. 13, 2001, pp. 1-11, SPE 65017, Society of Petroleum Engineers Inc., U.S.A.

X. Li, et al., An Integrated Transport Model for Ball-Sealer Diversion in Vertical and Horizontal Wells, Oct. 9, 2005, pp. 1-9, SPE 96339, Society of Petroleum Engineers, U.S.A.

* cited by examiner

MULTIPLE BALL LAUNCH ASSEMBLIES AND METHODS OF LAUNCHING MULTIPLE BALLS INTO A WELLBORE

BACKGROUND

1. Field of Invention

The invention is directed to ball launching assemblies for releasing balls into wellbores to facilitate completion operations in oil and gas wells and, in particular to surface-located ball launching assemblies capable of launching multiple balls in sequence.

2. Description of Art

Use of balls and ball seats in completion operations are generally known in the art. For example, typical ball seats are tubular members having a bore or passageway that is restricted by a seat. A ball or drop plug is disposed on the seat, preventing or restricting fluid from flowing through the bore of the ball seat and, thus, isolating the tubing or conduit section in which the ball seat is disposed. As the fluid pressure above the ball or drop plug builds up, the conduit can be pressurized for tubing testing or actuating a tool connected to the ball seat such as setting a packer. Ball seats are also used in cased hole completions, liner hangers, flow diverters, frac systems, and flow control equipment and systems.

Although the terms "ball seat" and "ball" are used herein, it is to be understood that a drop plug or other shaped plugging device or element may be used with any ball seats capable of receiving a ball to perform the required completion operation. For simplicity it is to be understood that the term "ball" includes and encompasses all shapes and sizes of plugs, balls, or drop plugs unless the specific shape or design of the "ball" is expressly discussed.

In certain completion operations, it is desired to drop or launch multiple balls into the wellbore so that more than one completion operation can be performed. For example, a first ball may be dropped or launched into the wellbore to set a packer. Thereafter, second, third, fourth, etc. balls may be dropped or launched into the wellbore to set an additional packer, set a bridge plug, set an anchor, run fracturing operations, or any other well completion operation. Multiple ball launch assemblies, thus, are designed to launch multiple balls into wellbores.

SUMMARY OF INVENTION

Broadly, the ball launch assemblies disclosed herein are surface-located ball launch assemblies that comprise multiple ball launch pods disposed around an outer wall surface of a housing and operatively associated with a flow tube or sleeve disposed within the housing. An actuator assembly operatively associated with the flow tube rotates the flow tube causing multiple balls to be launched in sequence into the wellbore. The actuator may be hydraulically or pneumatically actuated. In specific embodiments, one or more of the ball launch pods comprise a biased member that forces the ball against an outer wall surface of the flow tube until the flow tube is rotated such that a ball opening in the flow tube corresponding to the ball launch pod is placed in alignment with the ball launch pod. After alignment of the opening in the flow tube with the ball launch pod, the biased member forces the ball through the ball opening and into a bore of the flow tube that is in fluid communication with the wellbore. The ball is, thus, dropped or launched into the wellbore so that it can perform its designed downhole function.

In other specific embodiments, the multiple openings in the flow tube are all the same size so that multiple balls of the same diameter or shape can be sequentially launched. In other embodiments, the multiple openings in the flow tube are different sizes so that multiple balls of differing diameters or shape can be sequentially launched. In one particular embodiment, the openings are spirally disposed along the longitudinal length of the flow tube.

In one specific embodiment, the actuator assembly comprises a pneumatically actuated piston operatively associated with an incremental drive assembly such as a ratchet gear. Upon pressure being applied, the piston rotates the ratchet gear which in-turn rotates the flow tube. The ratchet gear is calibrated so that one application of pressure rotates the flow tube once and each of the openings in the flow tube are calibrated so that upon each actuation of the piston and, thus, ratchet gear, one opening is aligned with one ball launch pod, but the remaining openings in the flow tube are not in alignment with the other ball launch pods, or at least not in alignment with other ball launch pods that have not yet launched their respective balls.

In particular embodiments, the ball launch pods include an indictor capable of visually showing when a ball has been launched from the ball launch pod.

Figure 1:
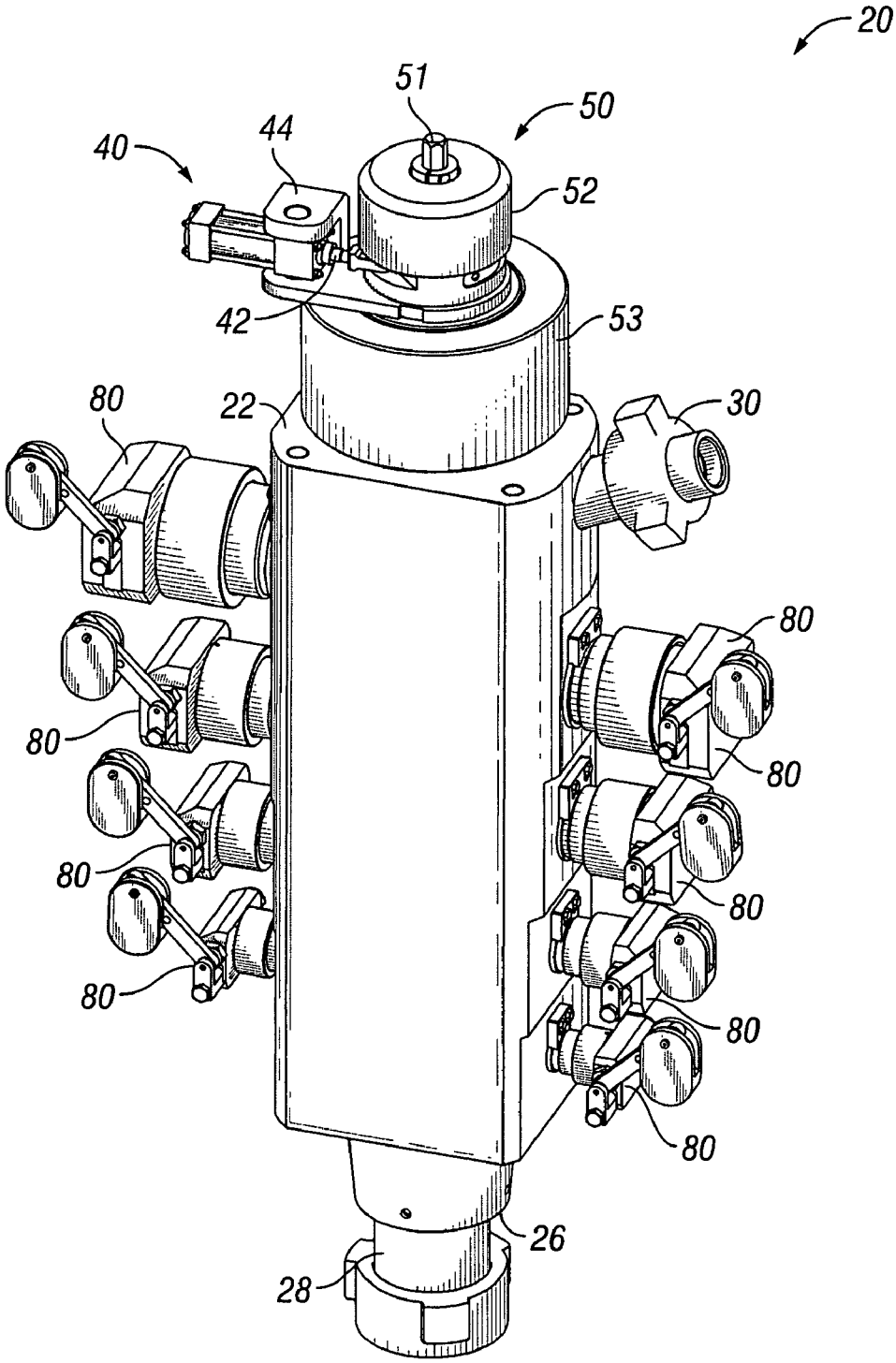
FIG. 1 is a perspective view of one specific embodiment of a multiple ball launch assembly disclosed herein.
Figure 2:
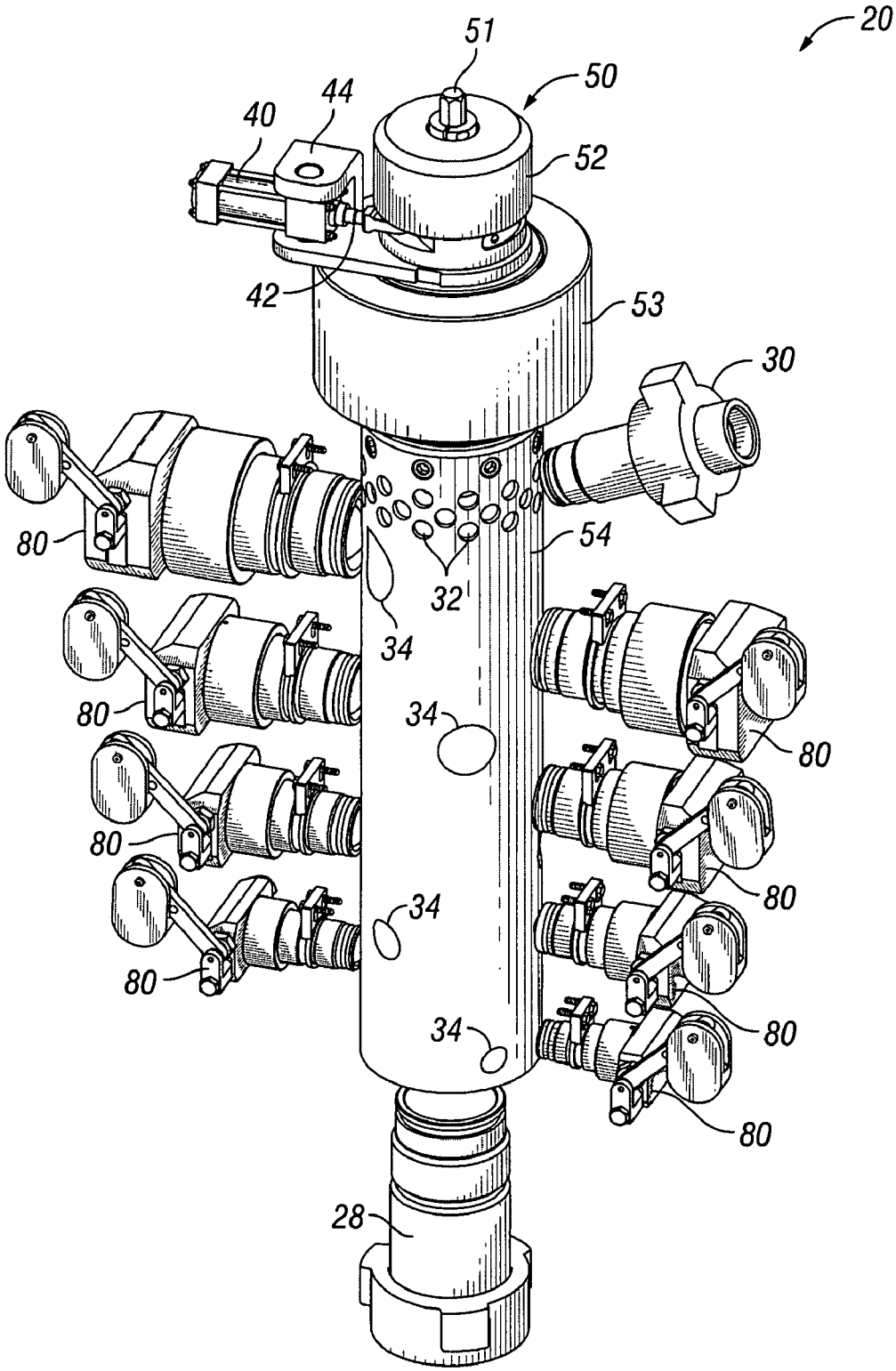
FIG. 2 is a perspective view of the multiple ball launch assembly of FIG. 1 shown for clarity purposes without the housing.
Figure 3:
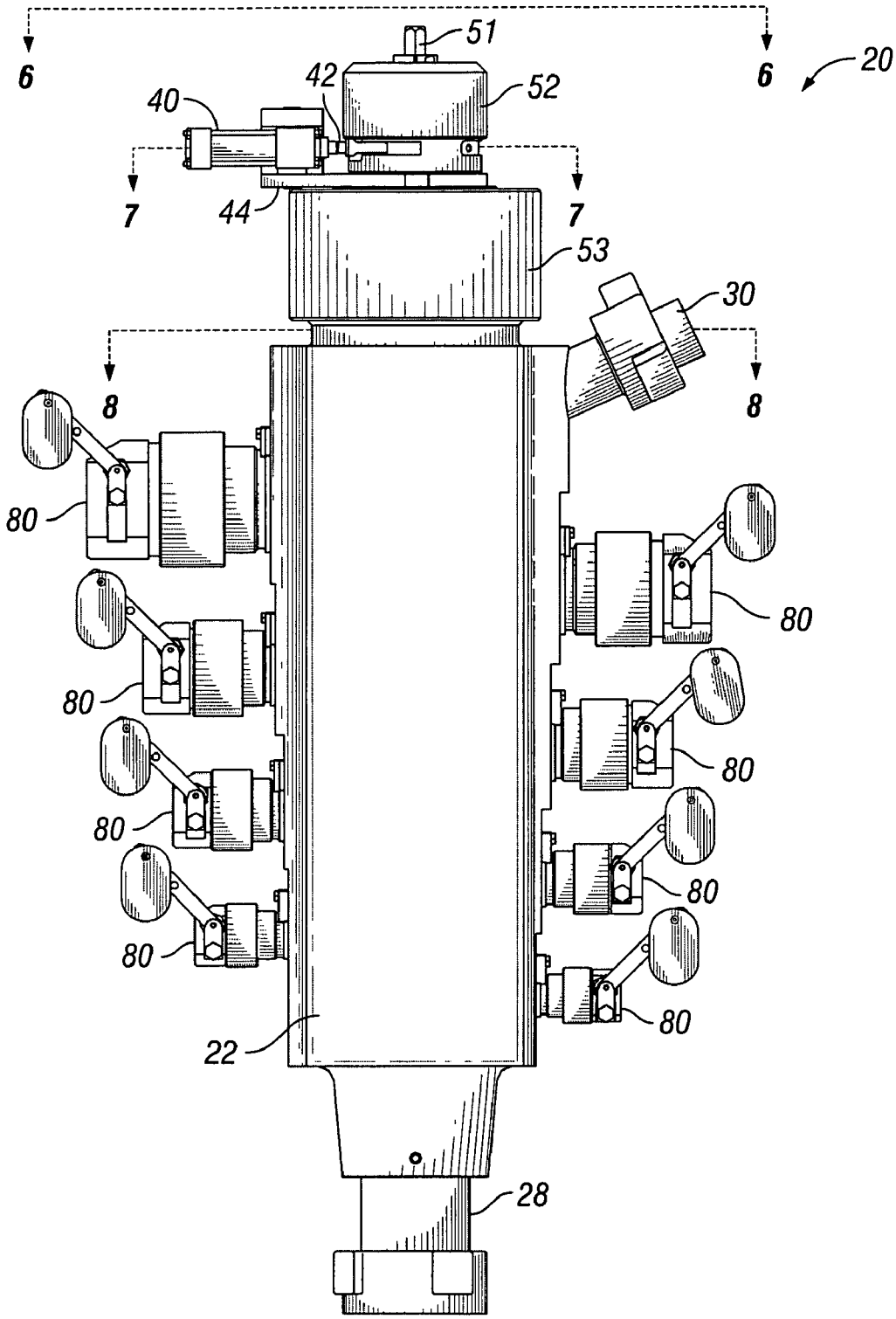
FIG. 3 is a front view of the multiple ball launch assembly of FIG. 1.
Figure 4:
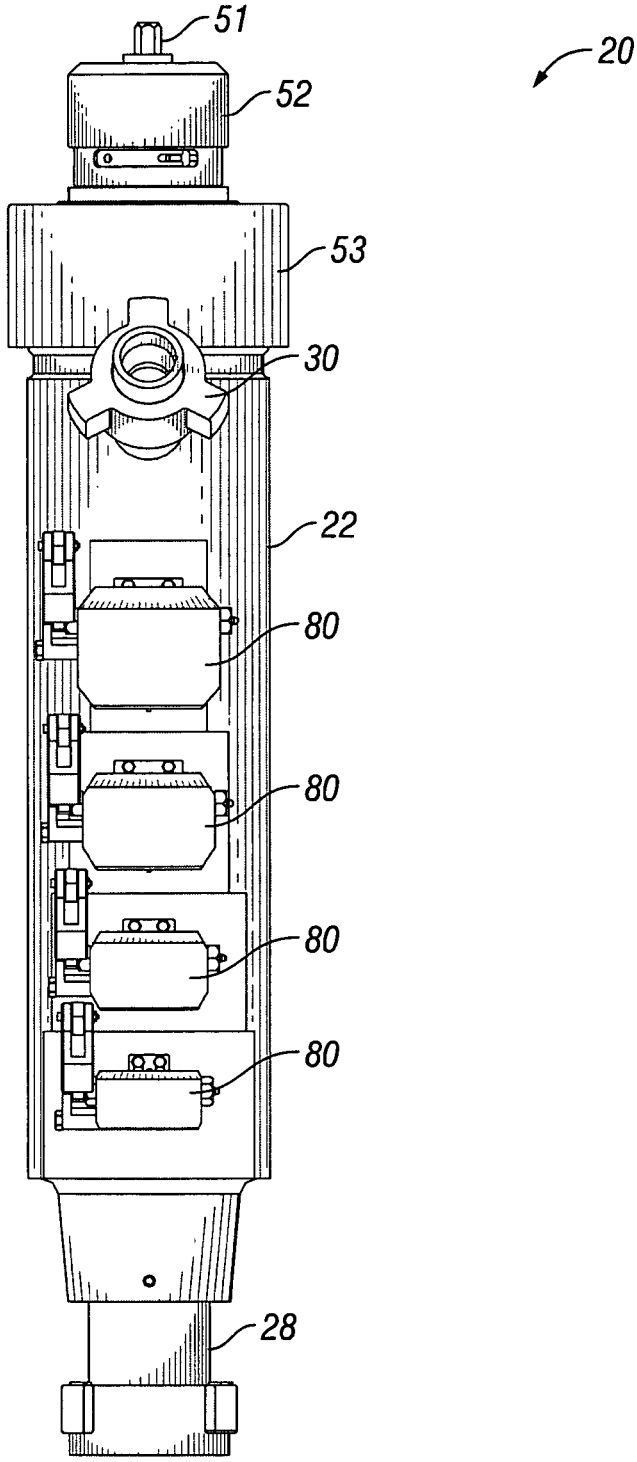
FIG. 4 is a side view of the multiple ball launch assembly of FIG. 1.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-16, multiple ball launch assembly 20 broadly comprises housing 22, actuator assembly 40, and a plurality of ball launch pods 80 secured to housing 22 such as through bolts. Housing 22 comprises upper end 24 with an opening (shown in FIG. 5) disposed therein and lower end 26 having an opening (shown in FIG. 5) disposed therein. Upper end 24 and lower end 26 include fasteners such as threads for securing additional components to upper end 24 and lower end 26. As shown in FIGS. 1-5, coupler 28 is connected to lower end 26 through threads (shown in FIG. 5). Coupler 28 allows multiple ball launch assembly 20 to be connected to wellbore tubing or casing (not shown). Upper end 24 is secured to additional components of multiple ball launch assembly 20 as discussed in greater detail below.

Multiple ball launch assembly 20 may also include flush line inlet 30 so that fluid can be pumped into, or out of, multiple ball launch assembly 20 as desired or necessary for the operation of multiple ball launch assembly 20.

Actuator assembly 40 is disposed at upper end 24. Although actuator assembly 40 may be any device known to persons skilled in the art, in the embodiment of FIGS. 1-16, actuator assembly 40 comprises drive assembly 50 operatively associated with piston 42 which is connected to piston bracket 44.

Figure 5:
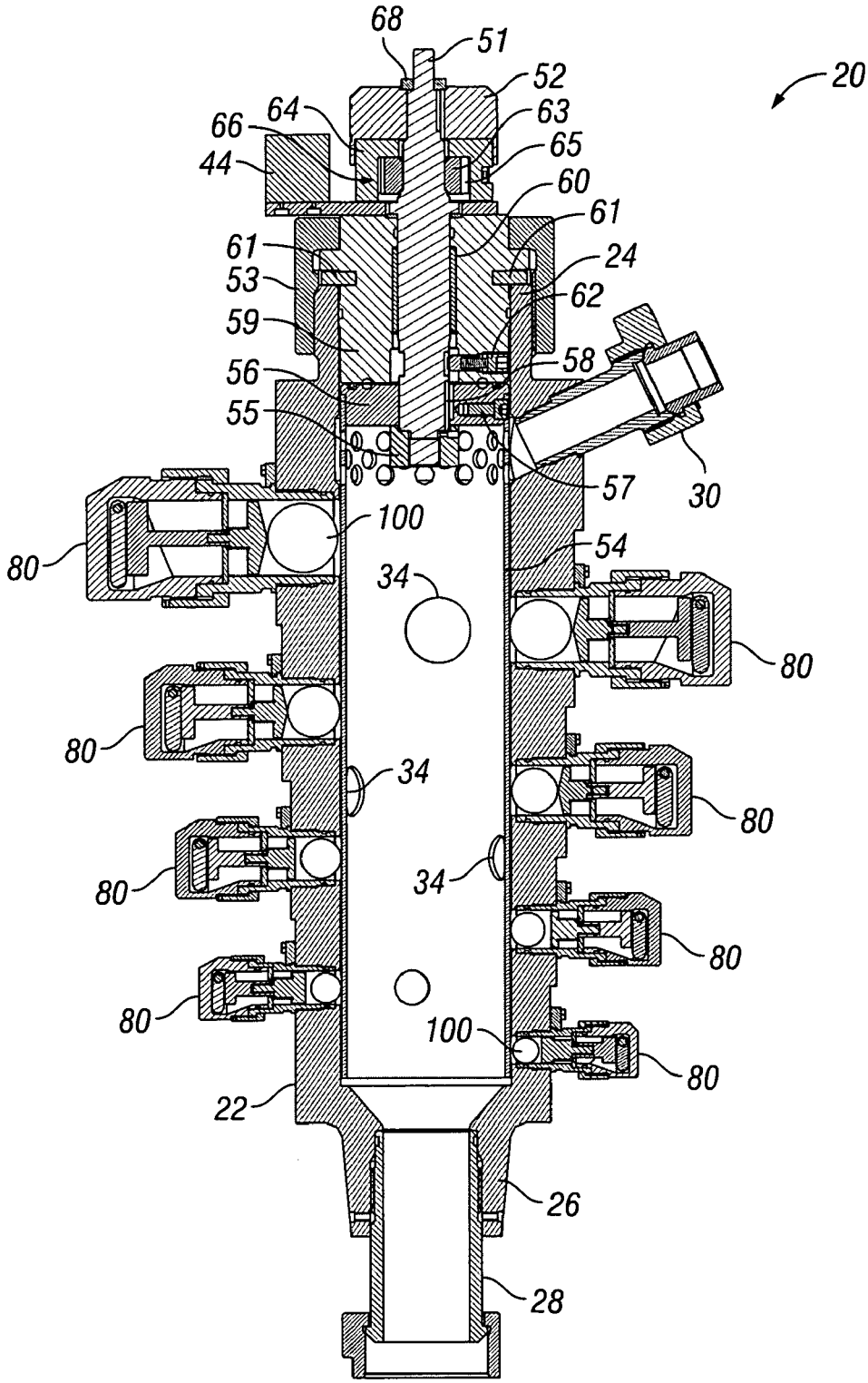
FIG. 5 is a cross-sectional view of the multiple ball launch assembly of FIG. 1.
Figure 6:
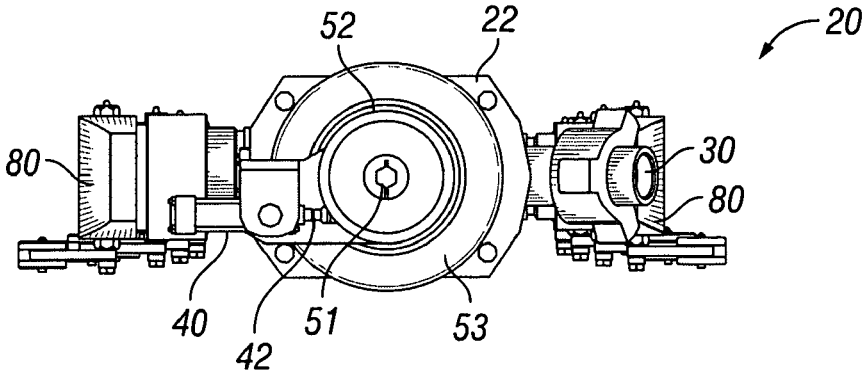
FIG. 6 is a top view of the multiple ball launch assembly of FIG. 1 taken along line 6-6 of FIG. 3.

As best illustrated in FIG. 5, drive assembly 50 comprises mandrel 51, top cap 52, incremental drive member 66, housing cap 53, flow tube or sleeve 54, bottom retainer 55, bottom cap 56 secured to flow tube 54 by bolt 57 and connected to mandrel 51 by key 58, and rotating inner top cap 59 through internal bearing 60 and secured to housing 22 by dowel pin 61. and. Bottom retainer 55 is secured to the lower end of mandrel 51 and in contact with bottom cap 56 to restrict upward movement of mandrel 51. Upper retainer 68 is secured to the upper end of mandrel 51 and in contact with top cap 52 to restrict upward movement. Upper end of mandrel 51 extends through upper retainer 68 so that mandrel can be rotated manually in the event that piston 42 fails. To facilitate manual rotation of mandrel 51, the upper end of mandrel 51 may have a hexagonal cross-section.

Housing cap 53 is releasably secured to upper end 24 of housing 22 such as through threads (not shown) or any other fastener member. Housing cap 53 and dowel pin 61 secure inner top cap 59 to housing 22. Piston bracket 44 is secured to inner top cap 59 by fasteners (not shown) such as bolts.

Flow tube 54 comprises one or more flush line openings 32 to permit fluids to flow into and out of flush line inlet 30. Flow tube 54 also comprises a plurality of ball openings 34 to permit the passage of a plurality of corresponding sized balls (not shown) from a plurality of corresponding ball launch pods. As shown in the embodiment of FIGS. 1-16, multiple ball launch assembly 20 comprises eight ball launch pods 80 each having a different size so that eight different sized balls can be launched by the multiple ball launch assembly 20. The arrangement of the ball openings 34 is designed so that only one ball opening 34 is aligned with a corresponding ball launch pod 80 at any given moment in time. Additionally, the arrangement of the ball openings 34 is designed so that each incremental rotation of flow tube 54 moves one ball opening 34 in alignment with one non-launched ball launch pod 80 and, simultaneously, places the other ball openings 34 out of alignment with the other ball launched pods 80, even if one or more of the other ball launch pods 80 has already launched its respective balls. Thus, sequential launching of a plurality of balls can be accomplished through the rotation of flow tube 54.

In the embodiment shown in FIGS. 1-16, ball openings 34 are spirally disposed along the longitudinal length of flow tube 54. In other specific embodiments, ball openings 34 in flow tube 54 are all the same size so that multiple balls of the same diameter or shape can be sequentially launched.

Figure 7:
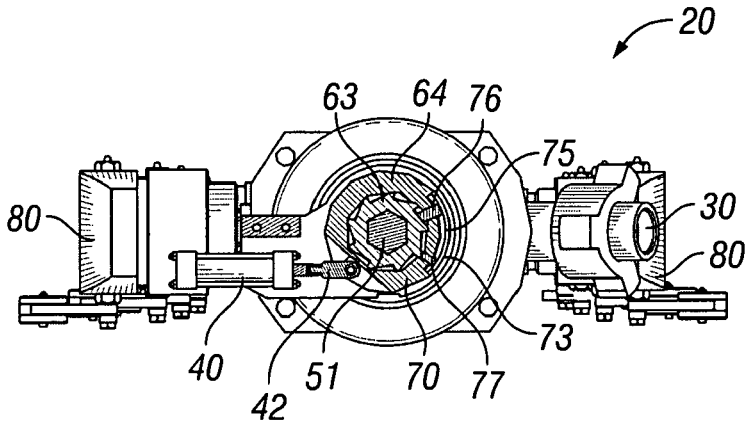
FIG. 7 is a cross-sectional view of the multiple ball launch assembly of FIG. 1 taken along line 7-7 of FIG. 3.
Figure 8:
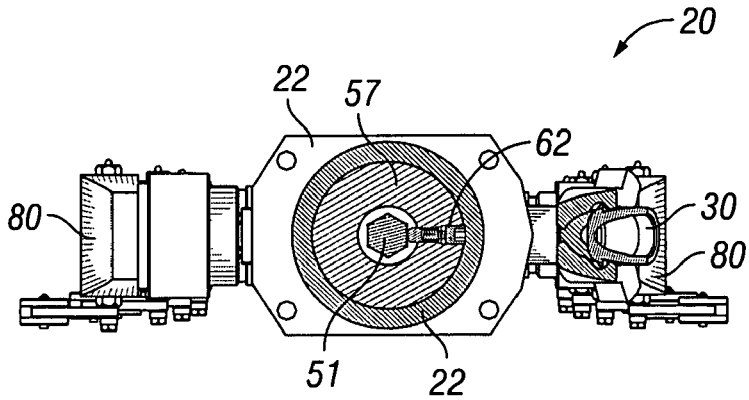
FIG. 8 is a cross-sectional view of the multiple ball launch assembly of FIG. 1 taken along line 8-8 of FIG. 3.
Figure 9:
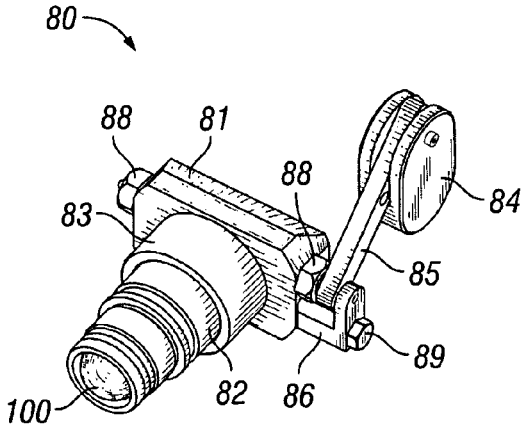
FIG. 9 is a front perspective view of a ball launch pod shown in the pre-launch position for use in connection with the multiple ball launch assembly shown in FIG. 1.
Figure 10:
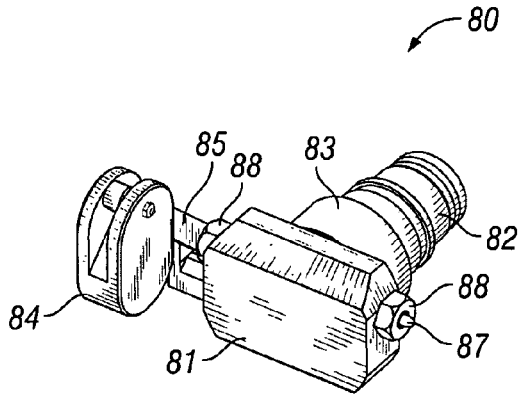
FIG. 10 is a back perspective view of the ball launch pod of FIG. 9 and also shown in the pre-launch position.

In the particular embodiment shown, incremental drive member 66 comprises ratchet assembly 70. As illustrated in FIG. 7, ratchet assembly 70 comprises ratchet gear 63 disposed in ratchet housing 64. Centralizing bushing 65 (FIG. 5) is disposed between ratchet gear 63 and the inner wall surface of ratchet housing 64. Ratchet housing 64 includes one or more slots 73 having leaf spring 75 disposed therein. Leaf spring 75 is secured to ratchet housing 64 by bolt 77. Pin 76 can moves radially so that as ratchet gear 63 is rotated, pin 76 slides along the outer wall surface of ratchet gear 63.

Figure 11:
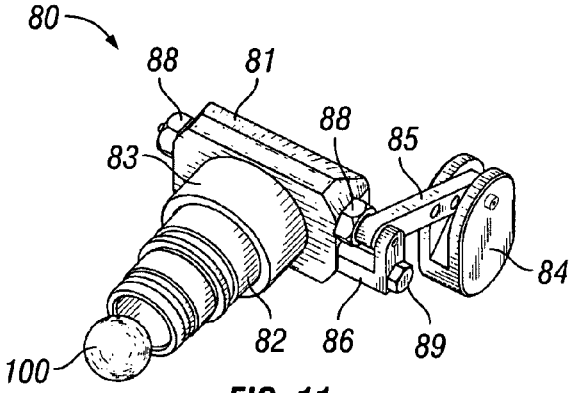
FIG. 11 is a front perspective view of the ball launch pod shown in FIG. 9 shown in the launch position.
Figure 12:
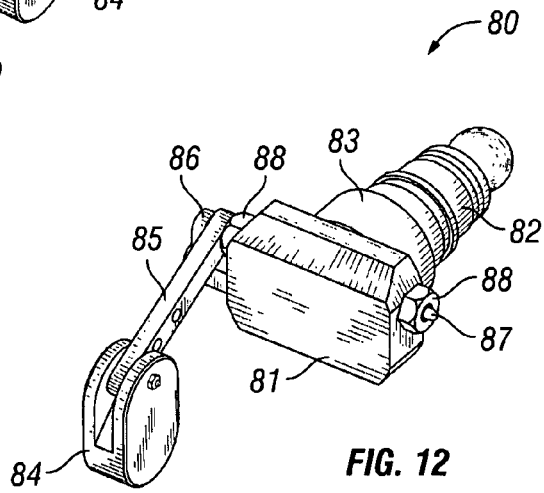
FIG. 12 is a back perspective view of a ball launch pod shown in FIG. 11 and also shown in the launch position.
Figure 13:
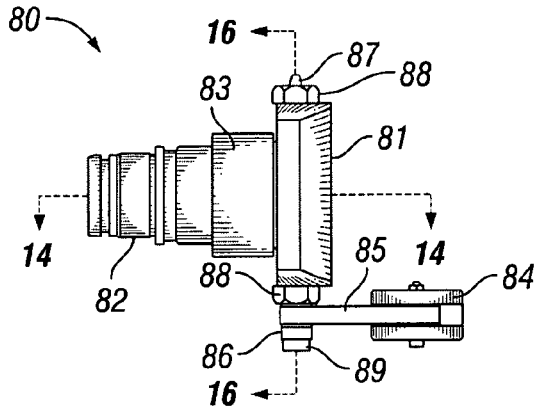
FIG. 13 is a top view of the ball launch pod of FIG. 9 shown in the pre-launch position.
Figure 14:
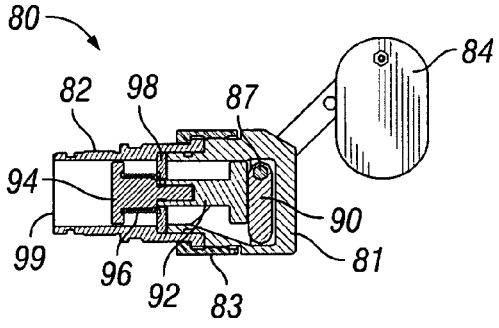
FIG. 14 is a cross-sectional view of the ball launch pod of FIG. 13 taken along the line 14-14 and also shown in the pre-launch position.
Figure 15:
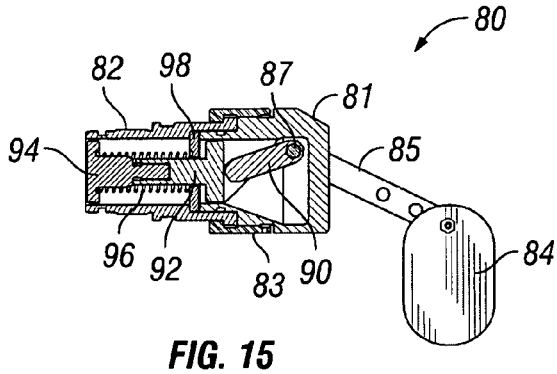
FIG. 15 is a cross-sectional view of the ball launch pod of FIG. 14 shown in the launch position.
Figure 16:
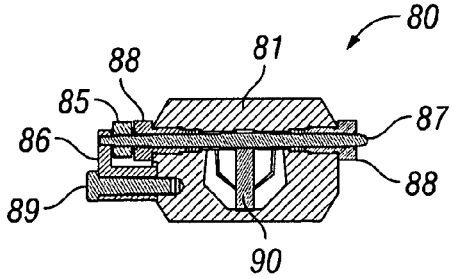
FIG. 16 is a cross-sectional view of the ball launch pod of FIG. 13 taken along the line 16-16 and also shown in the pre-launch position.

Referring now to FIGS. 9-16, in a specific embodiment, ball launch pod 80 comprises cam housing 81, ball housing 82, and threaded cap 83 for securing cam housing 81 to ball housing 82. Ball housing 82 may have threads (not shown) or other fastener device(s) for securing ball launch pod 80 to housing 22. In the embodiment show, ball launch pod 80 also comprises indicator 85 rotatably connected to indicator arm 85 which is rotatably connected to indicator shaft 87 which is secured to cam housing 81 through support bracket 86, bolt 89, and seal fittings 88 disposed at each end of indicator shaft 87. When ball 100 is within ball housing 82, indicator 84 is disposed in a first, pre-launched, position (FIGS. 9, 10, and 14) and when ball 100 has been released from ball housing 82, indicator 84 is in a second, launched, position (FIGS. 11, 12, and 15). Thus, an operator of multiple ball launch assembly 20 can visually verify when a ball has been launched from multiple ball launch assembly 20.

Cam 90 is disposed in cam housing 81 and is operatively associated with indicator shaft 87 such that actuation of cam 90 causes indicator shaft 87 to rotate which, in turn, moves indicator 84 from the pre-launched position (FIGS. 9, 10, and 14) to the launched position (FIGS. 11, 12, and 15).

Cam 90 may be in direct contact with ball 100 in the non-launched position. Alternatively, as shown in FIGS. 9-16, cam 90 can be operatively associated with cam plunger 92 which is secured, such as through threads (not shown) to ball plunger 94. Biased member 96, which is shown as a coiled spring operatively associated with spring ring 98 in FIGS. 14-15, is energized when ball launch pod 80 is in the non-launched position (FIGS. 9, 10, and 14) due to ball 100 being forced into the outer wall surface of flow tube 54. As discussed in greater detail below, during operation of multiple ball launch assembly 20, the opening 99 of ball launch pod 80 is blocked by flow tube 54 until flow tube is rotated and one ball opening 34 is aligned with opening 99. At that time, biased member 96 can release its stored energy to force ball 100 out of ball housing 82, through opening 99, and through ball opening 34 of flow tube 54, into the flow tube bore and, thus, into the wellbore. In so doing, cam 90 is rotated due to the lack of resistance provided the previously non-aligned flow tube 54, i.e., by ball 100 being forced into the outer wall surface of flow tube 54. In certain embodiments, indicator 84 is formed with sufficient weight such that when ball opening 34 is aligned with opening 99 so that ball 100 is permitted to move through opening 99 and through ball opening 34, the weight of indicator 84, through gravity, causes cam 90 to rotate which, in turn, assists the launching of ball 100 out of ball housing 82.

In operation, multiple ball launch assembly 20 is assembled such that flow tube 54 is initially oriented to block all of the openings 99 of ball launch pods 80. Multiple ball launch assembly 20 is then connected at the surface a wellbore by connecting lower end 26 to wellbore casing or tubing (not shown) and actuator assembly 40 is placed in connection with an actuator control unit, such as pneumatic or hydraulic controls.

After installation of multiple ball launch assembly 20, actuator assembly 40 is actuated which rotates drive assembly 50 to rotate flow tube 54. In so doing a first ball opening 34 in flow tube 54 is aligned with a first opening 99 of a first ball launch pod 80. As a result, a first ball 100 is launched from the first ball launch pod 80, through the first opening 99, through the first ball opening 34, into the bore of flow tube 54, and, thus, into the wellbore. Thereafter, actuator assembly 40 actuated to align a second ball opening 34 with a second opening 99 of a second ball launch pod 80. As a result, a second ball is launched from the second ball launch pod 80, through the second opening 99, through the second ball opening 34, into the bore of flow tube 54, and, thus, into the wellbore. The foregoing steps can be repeated until all of the balls are launched from the multiple ball launch assembly 20.

As discussed briefly above, when each of the first, second, third, etc., ball openings 34 of flow tube are aligned with each corresponding first, second, third, etc., openings 99 of ball launch pods 80, the corresponding ball 100 can be launched into the wellbore due to one or more of gravity acting on the ball, the release energy stored in a biased member which is transferred directly to the ball or indirectly to the ball through one or more of ball plunger 92 and/or cam plunger 94, and/or by camming action caused by the lowering of a weighted indicator which rotates a cam to push the ball, either directly or indirectly, out of openings 99.

It is to be understood that the invention is not limited to the exact details of construction, operation, exact materials, or embodiments shown and described, as modifications and equivalents will be apparent to one skilled in the art. For example, one or more of biased member 96, ball plunger 94, or cam plunger 92 is not required in ball launch pods 80. Moreover, ball launch pods 80 may be disposed at a sloping angle relative to housing 22 and flow tube 54 so that gravity assists the launching of ball 100. Additionally, the size of each ball launch pod and, thus, each ball, can vary or they can all be the same size. Further, the actuator assembly does not require a piston and the drive assembly does not require a ratchet assembly. Any other actuator assembly or drive assembly can be included. Moreover, rotation of the flow tube does not have to continually block openings 99 of ball launch pods 80 that have already launched their respective balls. Accordingly, the invention is therefore to be limited only by the scope of the appended claims.

What is claimed is:

1. A multiple ball launch assembly for a wellbore, the multiple ball launch assembly comprising:

a housing having an upper end, a lower end, and a housing bore disposed between the upper end and the lower end, the housing bore being adapted to be placed in fluid communication with a wellbore;

a plurality of ball launch pods disposed around an outer wall surface of the housing and in fluid communication with the housing bore, each of the ball launch pods comprising a ball housing for maintaining a ball prior to being launched into the wellbore;

a rotatable sleeve disposed in the housing bore, the sleeve having a sleeve bore in fluid communication with the wellbore and a plurality of ball openings, the plurality of ball openings corresponding to the plurality of ball launch pods such that each of the ball housings is sequentially placed in fluid communication with the sleeve bore by rotation of the sleeve;

an actuator assembly operatively associated with the sleeve for rotating the sleeve to align the plurality of ball openings with the corresponding plurality of ball launch pods.

2. The multiple ball launch assembly of claim 1, wherein the actuator assembly comprises a drive assembly having an incremental drive member such that each actuation of the actuator assembly causes the drive assembly to rotate the sleeve to align one of the plurality of ball openings with one of the plurality of ball launch pods so that a ball can be launched and subsequent incremental rotations of the sleeve by subsequent actuation of the actuator assembly sequentially aligns the remainder of the plurality of ball openings with the remainder of the corresponding ball launch pods so that the reminder of balls can be launched into the sleeve bore.

3. The multiple ball launch assembly of claim 2, wherein the actuator assembly comprises a pneumatically actuated piston.

4. The multiple ball launch assembly of claim 3, wherein the incremental drive member comprises a ratchet gear.

5. The multiple ball launch assembly of claim 1, further comprising a coupler secured to the lower end of the housing to facilitate connection of the multiple ball launch assembly to a wellbore tubular located at a surface of a well.

6. The multiple ball launch assembly of claim 1, wherein each of the plurality of ball launch pods comprise a ball launch plunger operatively associated with a biased member, the biased member being energized by the ball being restricted from being launched by an outer wall surface of the sleeve.

7. The multiple ball launch assembly of claim 1, wherein each of the plurality of ball launch pods comprise an indicator operatively associated with the ball, the indicator providing a first visual indication when the ball is contained within the ball housing and a second visual indication when the ball has been launched from the ball housing.

8. The multiple ball launch assembly of claim 7, wherein the indicator of each of the plurality of ball launch pods is operatively associated with a cam disposed in a cam housing of each of the plurality of ball launch pods such that rotation of the cam provides assistance in launching the ball from each of the plurality of ball launch pods.

9. The multiple ball launch assembly of claim 8, wherein each of the cams is operatively associated with a ball launch plunger operatively associated with a biased member within the ball housing of each of the plurality of ball launch pods, the biased member being energized by the ball of each of the plurality of ball launch pods being restricted from being launched by an outer wall surface of the sleeve.

10. The multiple ball launch assembly of claim 1, wherein the plurality of ball openings are spirally disposed along the longitudinal length of the sleeve.

11. The multiple ball launch assembly of claim 10, wherein each of the plurality of ball openings has a diameter and each of the diameters of the plurality of balls are different.

12. A multiple ball launch assembly for a wellbore, the multiple ball launch assembly comprising:

a housing having an upper end, a lower end, and a housing bore disposed between the upper end and the lower end, the housing bore being adapted to be placed in fluid communication with a wellbore;

a plurality of ball launch pods disposed around an outer wall surface of the housing and in fluid communication with the housing bore, each of the ball launch pods comprising a ball housing for maintaining a ball prior to being launched into the wellbore;

a rotatable sleeve disposed in the housing bore, the sleeve having a sleeve bore in fluid communication with the wellbore and a plurality of ball openings, the plurality of ball openings corresponding to the plurality of ball launch pods such that a ball from each of the ball launch pods can be launched from each of the plurality of ball launch pods, through a corresponding ball opening, and into the sleeve bore when the plurality of ball launch pods is aligned with a corresponding ball opening; and an actuator assembly comprising a drive assembly, the drive assembly being operatively associated with the sleeve such that an initial rotation of the sleeve aligns one of the plurality of ball openings with one of the plurality of ball launch pods so that a ball can be launched and subsequent rotations of the sleeve sequentially align the remainder of the plurality of ball openings with the remainder of the corresponding ball launch pods so that the reminder of balls can be launched into the sleeve bore.

13. The multiple ball launch assembly of claim 12, wherein each of the plurality of ball launch pods comprise an indicator operatively associated with the ball, the indicator providing a first visual indication when the ball is contained within the ball housing and a second visual indication when the ball has been launched from the ball housing.

14. The multiple ball launch assembly of claim 13, wherein the indicator of each of the plurality of ball launch pods is operatively associated with a cam disposed in a cam housing of each of the plurality of ball launch pods such that rotation of the cam provides assistance in launching the ball from each of the plurality of ball launch pods.

15. The multiple ball launch assembly of claim 14, wherein each of the cams is operatively associated with a ball launch plunger operatively associated with a biased member within the ball housing of each of the plurality of ball launch pods, the biased member being energized by the ball of each of the plurality of ball launch pods being restricted from being launched by an outer wall surface of the sleeve.

16. The multiple ball launch assembly of claim 15, wherein the actuator assembly comprises a pneumatically actuated piston and the drive assembly comprises an incremental drive member.

17. A method of launching multiple balls into a wellbore, the method comprising the steps of:

(a) disposing a multiple ball launch assembly in fluid communication with a wellbore, the multiple ball launch assembly comprising a housing, first and second ball launch pods disposed around an outer wall surface of the housing and in fluid communication with the housing bore, the first and second ball launch pods each comprising a ball housing for maintaining a ball prior to being launched into the wellbore;

a rotatable sleeve disposed in the housing bore, the sleeve having a sleeve bore in fluid communication with the wellbore, a first ball opening, and a second ball opening, the first ball opening corresponding to the first ball launch pod so that alignment of the first ball opening with the first ball launch pod causes a first ball to be launched from the first ball launch pod, through the first ball opening, and into the sleeve bore, and the second ball opening corresponding to the second ball launch pod so that alignment of the second ball opening with the second ball launch pod causes a second ball to be launched from the second ball launch pod, through the second ball opening, and into the sleeve bore; and an actuator assembly operatively associated with the sleeve for rotation of the sleeve;

(b) actuating the actuator assembly to rotate the sleeve to align the first ball opening with the first ball launch pod;

(c) launching the first ball from the first ball launch pod through the first ball opening in the sleeve into the sleeve bore and, thus, into the wellbore;

(d) actuating the actuator assembly to rotate the sleeve to align the second ball opening with the second ball launch pod; and (e) launching the second ball from the second ball launch pod through the second ball opening in the sleeve into the sleeve bore and, thus, into the wellbore.

18. The method of claim 17, wherein the multiple ball launch assembly comprises a third ball launch pod having a third ball and the sleeve comprises a third ball opening corresponding to the third ball launch pod, and wherein the method further comprises the steps of:

(f) actuating the actuator assembly to rotate the sleeve to align the third ball opening with the third ball launch pod; and (g) launching the third ball from the third ball launch pod through the third ball opening in the sleeve into the sleeve bore and, thus, into the wellbore.

19. The method of claim 18, wherein the multiple ball launch assembly comprises at least one additional ball launch pod having at least one additional ball and the sleeve comprises at least one additional ball opening corresponding to each of the at least one additional ball launch pods, and wherein the method further comprises the steps of:

(h) actuating the actuator assembly to rotate the sleeve to sequentially align each of the at least one additional ball openings with each of the at least one additional ball launch pods causing each of the additional balls disposed in each of the additional ball launch pods to be launched into the wellbore.

20. The method of claim 18, wherein upon launching each of the first ball, second ball, and third ball, each of the first ball launch pod, the second ball launch pod, and the third ball launch pod provides a visual indication that the ball has been launched.

* * * * *